US005387100A

United States Patent [19]

Kobayashi

[11] Patent Number: 5,387,100

[45] Date of Patent: Feb. 7, 1995

[54] SUPER OFF-STOICHIOMETRIC COMBUSTION METHOD

[75] Inventor: Hisashi Kobayashi, Putnam Valley, N.Y.

[73] Assignee: Praxair Technology, Inc., Danbury, Conn.

[21] Appl. No.: 197,991

[22] Filed: Feb. 17, 1994

[51] Int. Cl.[6] ..... F23M 3/04

[52] U.S. Cl. ..... 431/10; 431/8

[58] Field of Search ..... 431/8, 10; 60/733

[56] References Cited

U.S. PATENT DOCUMENTS

| | | | |
|---|---|---|---|
| 4,378,205 | 3/1983 | Anderson | 431/5 |
| 4,511,325 | 4/1985 | Voorheis | 431/8 |
| 4,790,743 | 12/1988 | Leikert et al. | 431/8 |
| 4,946,382 | 8/1990 | Kobayashi et al. | 431/8 |
| 4,988,285 | 1/1991 | Delano | 431/5 |
| 5,076,779 | 12/1991 | Kobayashi | 431/5 |
| 5,203,859 | 4/1993 | Khinkis et al. | 432/30 |
| 5,209,656 | 5/1993 | Kobayashi et al. | 431/187 |
| 5,242,296 | 9/1993 | Tuson et al. | 431/10 |
| 5,256,058 | 10/1993 | Slavejkov et al. | 431/187 |
| 5,267,850 | 12/1993 | Kobayashi et al. | 431/8 |

*Primary Examiner*—Carroll B. Dority
*Attorney, Agent, or Firm*—Stanley Ktorides

[57] ABSTRACT

A combustion method which employs highly fuel-rich combustion and highly fuel-lean combustion separately and simultaneously within a combustion zone followed by intermixture of their resulting gases within the combustion zone for further combustion.

9 Claims, 3 Drawing Sheets

SUPER OFF-STOICHIOMETRIC COMBUSTION METHOD

TECHNICAL FIELD

This invention relates generally to combustion and is particularly useful for carrying out combustion with reduced generation of nitrogen oxides.

BACKGROUND ART

Nitrogen oxides (NOx) are a significant pollutant generated during combustion and it is desirable to reduce their generation in carrying out combustion. It is known that combustion may be carried out with reduced NOx generation by using technically pure oxygen or oxygen-enriched air as the oxidant as this reduces the amount of nitrogen provided to the combustion reaction on an equivalent oxygen basis. However the use of an oxidant having a higher oxygen concentration than that of air causes the combustion reaction to run at a higher temperature and this higher temperature kinetically favors the formation of NOx.

Accordingly, it is an object of this invention to provide a method for carrying out combustion, which may be practiced using an oxidant having a higher oxygen concentration than that of air, while achieving reduced generation of nitrogen oxides.

SUMMARY OF THE INVENTION

The above and other objects, which will become apparent to one skilled in the art upon a reading of this disclosure, are attained by the present invention which is:

A combustion method comprising:

(A) forming a rich streamby injecting into a combustion zone first oxidant, being a fluid having an oxygen concentration of at least 30 volume percent, and first fuel in a ratio within the range of from 5 to 50 percent of stoichiometric;

(B) forming a lean stream by injecting into the combustion zone second oxidant and second fuel in a ratio of greater than 200 percent of stoichiometric;

(C) combusting first oxidant and first fuel within the combustion zone and producing combustion reaction products;

(D) combusting second oxidant and second fuel within the combustion zone and producing products of complete combustion and remaining oxygen; and (E) mixing remaining oxygen with combustion reaction products within the combustion zone and combusting said remaining oxygen with said combustion reaction products.

As used herein the terms "nitrogen oxides" and "NOx" mean one or more of nitrous oxide ($N_2O$), nitric oxide (NO), nitrogen trioxide ($N_2O_3$), nitrogen tetroxide ($N_2O_4$), nitrogen dioxide ($NO_2$), trinitrogen tetroxide ($N_3O_4$) and nitrogen trioxide ($NO_3$).

As used herein the term "products of complete combustion" means one or more of carbon dioxide and water vapor.

As used herein the term "products of incomplete combustion" means one or more of carbon monoxide, hydrogen, carbon and partially combusted hydrocarbons.

As used herein the term "unburned fuel" means fuel which has undergone no combustion and/or products of incomplete combustion.

As used herein the term "momentum flux" means the amount of fluid momentum flowing per unit time and expressed as the product of mass flux and fluid velocity.

DETAILED DESCRIPTION

The invention will be described in detail with reference to the Drawings.

Figure 1:
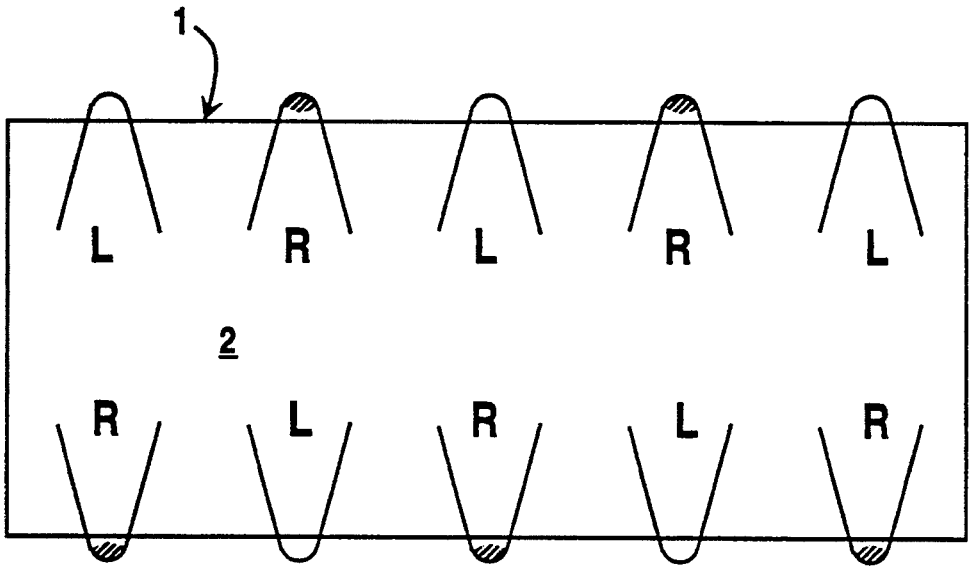
FIG. 1 is a simplified plan view of one embodiment for carrying out the method of this invention wherein a plurality of rich and lean streams are formed within the combustion zone in alternative sequence and evenly spaced.
Figure 2:
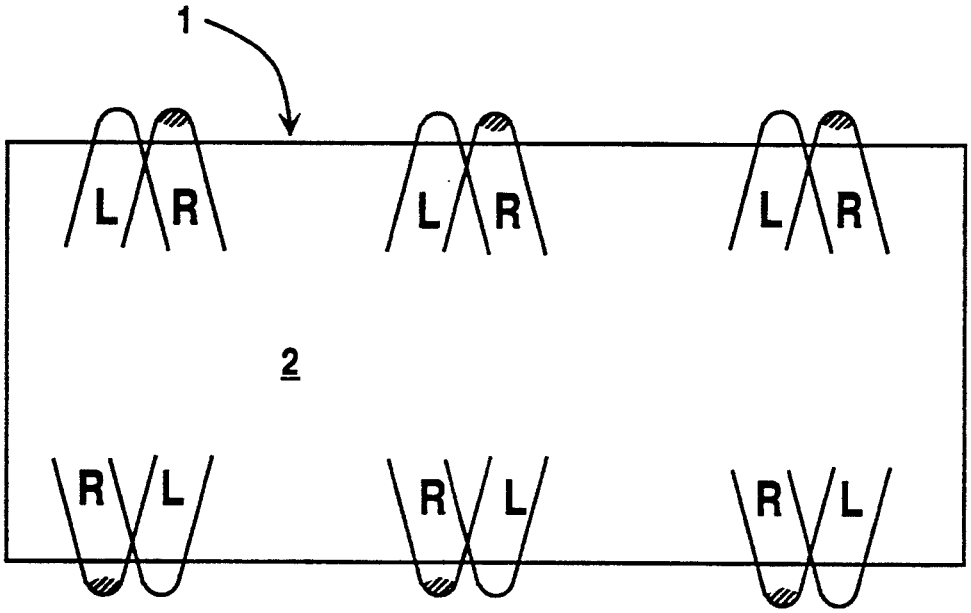
FIG. 2 is a simplified plan view of another embodiment for carrying out the method of this invention wherein a plurality of rich and lean stream pairs are formed within the combustion zone.

Referring now to FIGS. 1 and 2, furnace 1 defines furnace zone or combustion zone 2. The furnace may be any suitable industrial furnace such as, for example, a glassmaking furnace, a steelmaking furnace, an aluminum melting furnace, a cement kiln or an incinerator.

First fuel and first oxidant are injected into combustion zone 2 to form rich stream R. The embodiment illustrated in FIG. 1 shows the formation of five rich streams in combustion zone 2. In the embodiment illustrated in FIG. 2, six rich streams R are formed in combustion zone 2. The first fuel and oxidant is injected using appropriate burners or lances which are not illustrated in FIGS. 1 and 2. A burner is a device which provides both fuel and oxidant into a combustion zone and a lance is a device which injects only one of fuel and oxidant into a combustion zone. The first fuel and oxidant may be injected together in a premixed condition into combustion zone 2 or may be injected separately into combustion zone 2 and thereafter mix within combustion zone 2 to form the first fuel and oxidant mixture R within combustion zone 2.

The first fuel may be any gas or other fluid which contains combustibles which may combust in the combustion zone. Among such fuels one can name natural gas, coke oven gas, propane, methane and oil.

The first oxidant is a fluid having an oxygen concentration of at least 30 volume percent oxygen, preferably at least 90 volume percent oxygen. The first oxidant may be technically pure oxygen having an oxygen concentration of 99.5 percent or more.

The first fuel and oxidant are provided into combustion zone 2 at flowrates such that the ratio of first oxygen to first fuel in stream R is within the range of from 5 to 50 percent, preferably within the range of from 10 to 30 percent of stoichiometric. The stoichiometric amount of first oxygen is the amount of first oxygen required to completely combust the first fuel injected into combustion zone 2 to form stream R.

Preferably the rich stream has a velocity within the combustion zone which exceeds 50 feet per second and is generally within the range of from 50 to 1500 feet per second. Preferably this high velocity is attained by injecting the fuel at the high velocity while entraining a low velocity oxygen stream into the fuel to form the rich stream. The low velocity of the oxygen stream serves to keep furnace gases away from the nozzle through which the fuel and oxidant are injected, thus helping to reduce the degree of fouling or corrosion experienced by the nozzle. It is particularly preferred that the method disclosed in U.S. Pat. No. 5,267,850—Kobayashi et al., incorporated herein by reference, be employed to form the rich stream in the practice of this invention. Moreover, it is also particularly preferred that the method disclosed by this patent also be employed to form the lean stream in the practice of this invention.

The first fuel and first oxidant combust within combustion zone 2 to produce combustion reaction products. Combustion reaction products may include products of complete combustion but, owing to the defined substoichiometric oxygen to fuel ratio, will include unburned fuel. The incomplete combustion of the first fuel with the first oxidant enables the combustion of first fuel and first oxidant to proceed at a substantially lower temperature than would otherwise be the case, thus reducing the tendency of NOx to form.

There is also injected into the combustion zone second fuel and second oxidant to form one or more lean streams L. In the embodiment illustrated in FIG. 1, five lean streams L are employed, each of which is formed in the combustion zone flowing in a direction so as to meet an R stream head on, i.e., to directly intersect an R stream. In the practice of this invention, the R and L streams intermix in the combustion zone after at least some of the second fuel in the L stream has been substantially combusted and the R and L streams have mixed with furnace gases. In the embodiment illustrated in FIG. 2, six lean streams L are employed, each of which is formed in the combustion zone adjacent to, but separated from, an R stream so as to enable the requisite substantial combustion of the second fuel prior to the intermixture of the lean and rich streams. In order to assist in achieving the aforedescribed substantial combustion, especially when the rich and lean streams are formed close to one another within the combustion zone, it is preferred that the momentum flux of the rich stream be within a factor of 3, i.e. not more than 3 times or less than one-third, of the momentum flux of the lean stream. If the streams have widely disparate momentum fluxes, the low momentum flux stream will be quickly drawn into the high momentum flux stream prior to the substantial combustion described above.

The second fuel and second oxidant is formed in combustion zone 2 using appropriate burners and lances which are not illustrated in FIGS. 1 and 2. The second fuel and oxidant may be injected together in a premixed condition into combustion zone 2 or may be injected separately into combustion zone 2 and thereafter mix within combustion zone 2 to form the second fuel and oxidant mixture L within combustion zone 2.

The second fuel may be any gas or other fluid which contains combustibles which may combust in the combustion zone. Among such fuels one can name natural gas, coke oven gas, propane, methane and oil.

The second oxidant may be any fluid which contains oxygen, such as air, oxygen-enriched air or technically pure oxygen.

The second fuel and second oxidant are provided into combustion zone 2 at flowrates such that the ratio of second oxygen to second fuel in stream L is greater than 200 percent of stoichiometric, preferably within the range of from 200 to 1000 percent of stoichiometric. The stoichiometric amount of second oxygen is the amount of second oxygen required to completely combust the second fuel injected into combustion zone 2 to form stream L. High stoichiometric ratios with an oxidant having a high oxygen concentration are particularly preferred because they result in a lower combustion temperature and a lower nitrogen concentration within the combustion reaction resulting in lower NOx formation. In a particularly preferred embodiment of the invention the second oxidant is a fluid having an oxygen concentration of at least 30 volume percent and the ratio of second oxygen to second fuel in stream L exceeds 300 percent of stoichiometric.

The second fuel and second oxidant combust within combustion zone 2 to produce products of complete combustion and remaining oxygen which is second oxygen which does not combust with second fuel owing to the excess amount of second oxygen to second fuel in stream L. There may also be produced some unburned fuel.

Within combustion zone 2 remaining oxygen thereafter mixes with combustion reaction products which resulted from the combustion of the first fuel and oxidant and combusts with the unburned fuel of the combustion reaction products. Unburned fuel is completely combusted with remaining oxygen within the combustion zone. The combustion within the combustion zone serves to generate heat which may be used for heating, melting, drying or other purposes. The resulting gases are exhausted from the combustion zone after the combustion.

FIGS. 3A, 3B, 4A, 4B, 5A, 5B, 6A and 6B each illustrate various embodiments of burners, in cross-sectional and head on views, which may be used to inject the first fuel and oxidant as stream R and the second fuel and oxidant as stream L into the combustion zone.

EXAMPLES

The following examples and comparative example are provided to further illustrate the invention and the advantages attainable thereby. They are not intended to be limiting.

Figure 3A:
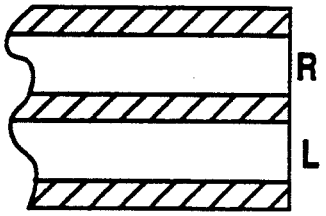
FIGS. 3A, 4A, 5A and 6A are cross-sectional representations of embodiments of a burner apparatus which may be used in the practice of this invention.
Figure 3B:
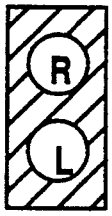
FIGS. 3B, 4B, 5B and 6B are head on representations of the burner apparatus embodiments illustrated respectively in FIGS. 3A, 4A, 5A and 6A.
Figure 4A:
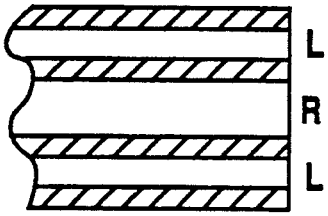
Figure 4B:
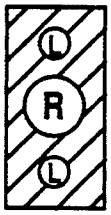
Figure 5A:
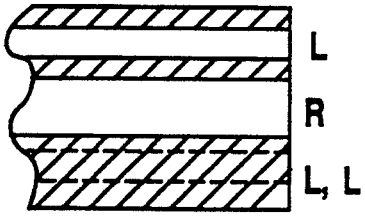
Figure 5B:
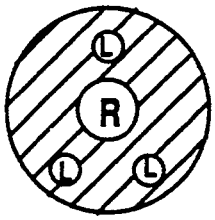
Figure 6A:
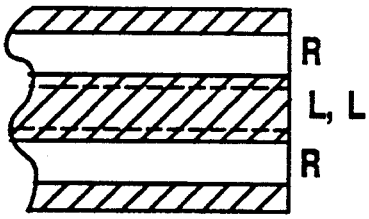
Figure 6B:
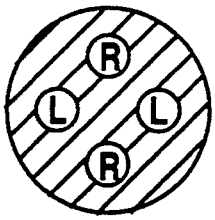
Figure 7:
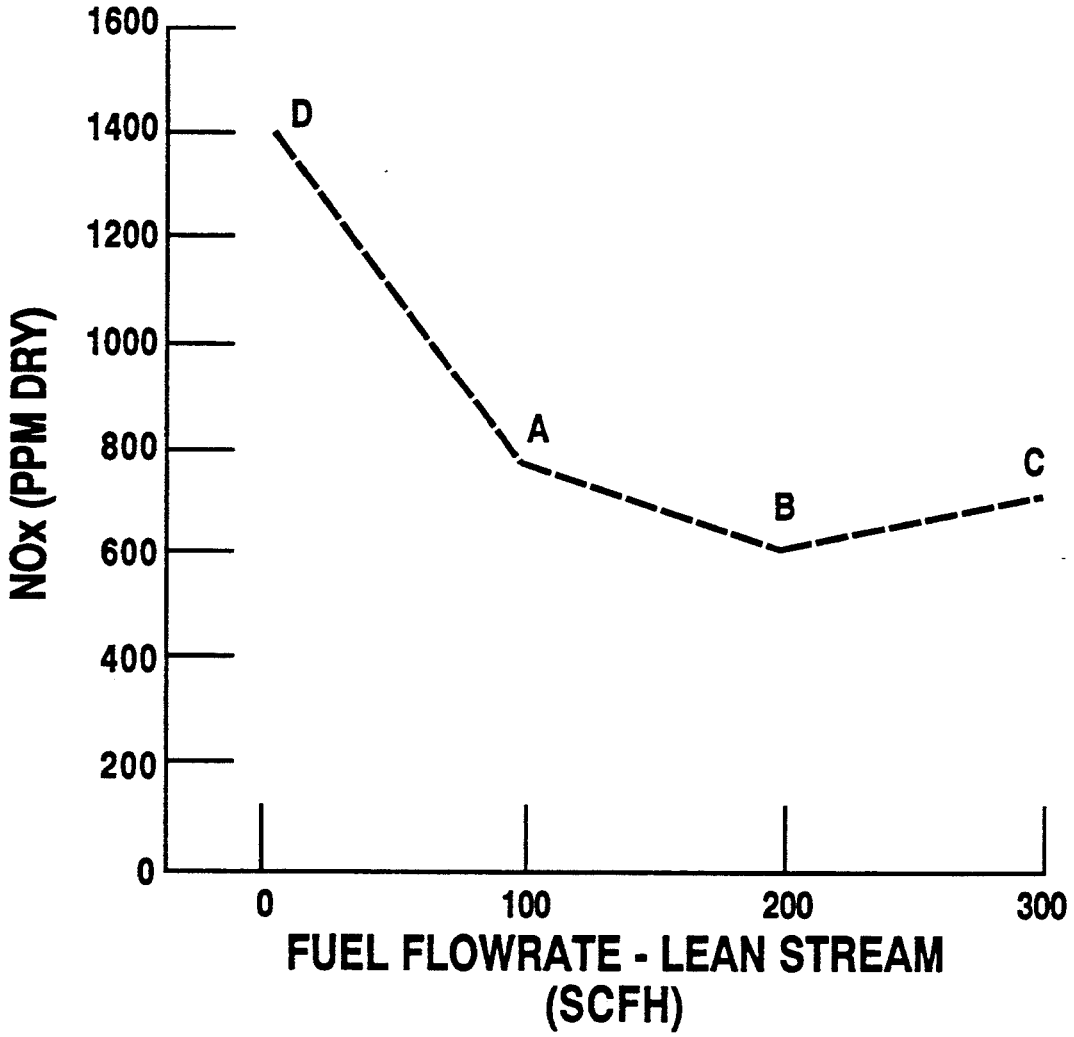
FIG. 7 is a graphical representation of test results attained in carrying out examples of the invention and comparative examples.

Using the arrangement illustrated in FIGS. 3A and 3B, and employing a cylindrical furnace measuring 3 feet inner diameter by 10.5 feet length, three tests of the invention, labelled A, B and C were carried out at the conditions set forth in TABLE I and using burners such as that disclosed in U.S. Pat. No. 5,267,850. The fuel was natural gas and the oxidant was commercial oxygen having an oxygen concentration exceeding 99.5 mole percent. For comparative purposes a test was carried out without a lean stream but rather using oxidant without any fuel. This is reported as D in TABLE I. In order to provide a significant and constant concentration of nitrogen in the furnace atmosphere, 150 standard cubic feet per hour of nitrogen was injected into the furnace from the furnace side wall. The results are also shown graphically in FIG. 7. As can be seen, surprisingly, significantly lower NOx levels are attained with the practice of this invention compared with the use of oxidant without fuel to provide additional oxygen into a combustion zone to complete the combustion. While not wishing to be held to any theory it is believed that the surprisingly advantageous results attained are due to the increased momentum flux of the lean stream by adding the high velocity fuel stream. In test D the secondary oxidant velocity was low and the momentum flux of the rich stream was much higher than that of the lean stream.

TABLE I

| | A | B | C | D |
|---|---|---|---|---|
| RICH STREAM | | | | |
| Fuel Flowrate (SCFH) | 900 | 800 | 700 | 1000 |
| Oxidant Flowrate (SCFH) | 450 | 400 | 350 | 5000 |
| Stoichiometric Ratio (%) | 25 | 25 | 25 | 25 |
| Fuel Velocity (Ft/Sec) | 734 | 652 | 571 | 815 |
| Oxidant Velocity (Ft/Sec) | 13 | 11 | 10 | 14 |
| Momentum Flux $\frac{(Lb\text{-}Ft)}{Sec^2}$ | 7.86 | 6.21 | 4.75 | 9.70 |
| LEAN STREAM | | | | |
| Fuel Flowrate (SCFH) | 100 | 200 | 300 | 0 |
| Oxidant Flowrate (SCFH) | 1550 | 1600 | 1650 | 1500 |
| Stoichiometric Ratio (%) | 775 | 400 | 275 | — |
| Fuel Velocity (Ft/Sec) | 326 | 652 | 978 | — |
| Oxidant Velocity (Ft/Sec) | 145 | 150 | 154 | 140 |
| Momentum Flux $\frac{(Lb\text{-}Ft)}{Sec^2}$ | 5.64 | 7.13 | 9.39 | 4.93 |
| NOx (ppm, dry basis) | 775 | 650 | 725 | 1425 |

The very low ratio of oxygen to fuel in the R stream serves to reduce $NO_x$ generation because the low combustion temperature and the fuel rich conditions within the R stream do not kinetically favor $NO_x$ formation. The very high ratio of oxygen to fuel in the L stream serves to reduce $NO_x$ generation because owing to the very low amount of second fuel available for combustion with second oxygen, the temperature of the combustion in the L stream remains below the level which kinetically favors $NO_x$ formation. The subsequent combustion of the remaining oxygen with unburned fuel takes place under conditions of high mixing and dilution because of the separation of the R and L streams and the subsequent intermixture with the presence of combustion reaction products such as products of complete combustion. This mixing and dilution serves to keep localized pockets of high oxygen concentration from occurring within the combustion zone thus serving to ensure that most of the remaining oxygen reacts with unburned fuel at low flame temperatures. The net effect of the invention is efficient combustion within the combustion zone without high $NO_x$ generation.

Although the invention has been described in detail with reference to certain specific embodiments, those skilled in the art will recognize that there are other embodiments of the invention within the spirit and the scope of the claims.

I claim:

1. A combustion method comprising:

(A) forming a rich stream by injecting into a combustion zone first oxidant, being a fluid having an oxygen concentration of at least 30 volume percent, and first fuel in a ratio within the range of from 5 to 50 percent of stoichiometric;

(B) forming a lean stream by injecting into the combustion zone second oxidant and second fuel in a ratio of greater than 200 percent stoichiometric;

(C) combusting first oxidant and first fuel within the combustion zone and producing combustion reaction products;

(D) combusting second oxidant and second fuel within the combustion zone and producing products of complete combustion and remaining oxygen; and (E) mixing remaining oxygen with combustion reaction products within the combustion zone and combusting said remaining oxygen with said combustion reaction products.

2. The method of claim 1 wherein a plurality of rich streams are formed within the combustion zone.

3. The method of claim 1 wherein a plurality of lean streams are formed within the combustion zone.

4. The method of claim 1 wherein a plurality of rich streams and plurality of lean streams are formed within the combustion zone.

5. The method of claim 4 wherein rich and lean streams are formed in alternative sequence within the combustion zone.

6. The method of claim 5 wherein the rich and lean streams are evenly spaced within the combustion zone.

7. The method of claim 4 wherein a plurality of rich and lean stream pairs are formed within the combustion zone.

8. The method of claim 1 wherein the momentum flux of the rich stream is within a factor of three of the momentum flux of the lean stream.

9. The method of claim 1 wherein the second oxidant is a fluid having an oxygen concentration of at least 30 volume pecent and the ratio of second oxidant to second fuel in the lean stream exceeds 300 percent of stoichiometric.

* * * * *

UNITED STATES PATENT AND TRADEMARK OFFICE

CERTIFICATE OF CORRECTION

PATENT NO. : 5,387,100

DATED : February 7, 1995

INVENTOR(S) : H. Kobayashi

It is certified that error appears in the above-identified patent and that said Letters Patent is hereby corrected as shown below:

In column 1, line 36 delete "streamby" and insert therefor - - stream by - -.

In claim 1, line 9 between "percent" and "stoichiometric" insert - - of - -.

Signed and Sealed this

Thirtieth Day of June, 1998

*Attest:*

*Attesting Officer*

Bruce Lehman

BRUCE LEHMAN

*Commissioner of Patents and Trademarks*